United States Patent [19]

Popp et al.

[11] Patent Number: 4,569,818

[45] Date of Patent: Feb. 11, 1986

[54] CONTAINER FOR STORING RADIOACTIVE MATERIAL

[75] Inventors: Franz-Wolfgang Popp, Wedemark; Kürt Füring, Solms, both of Fed. Rep. of Germany

[73] Assignee: Deutsche Gesellschaft für Wiederaufarbeitung von Kernbrennstoffen mbH, Hanover, Fed. Rep. of Germany

[21] Appl. No.: 486,449

[22] Filed: Apr. 19, 1983

[30] Foreign Application Priority Data

Apr. 22, 1982 [DE] Fed. Rep. of Germany ..... 3214880

[51] Int. Cl.[4] ..... G21F 5/00

[52] U.S. Cl. ..... 376/272; 250/506.1

[58] Field of Search ..... 250/506.1, 507.1, 515.1; 252/633; 376/272, 416, 417, 900; 220/83

[56] References Cited

U.S. PATENT DOCUMENTS

| | | | |
|---|---|---|---|
| 3,432,666 | 3/1969 | Nash et al. | 250/506.1 |
| 4,031,921 | 6/1977 | Maroni et al. . | |
| 4,272,683 | 6/1981 | Baatz et al. | 250/506.1 |

FOREIGN PATENT DOCUMENTS

| | | |
|---|---|---|
| 2740933 | 1/1979 | Fed. Rep. of Germany . |
| 2942092 | 4/1981 | Fed. Rep. of Germany . |
| 2258692 | 8/1975 | France . |
| 1005196 | 9/1965 | United Kingdom . |
| 2009657 | 6/1979 | United Kingdom . |
| 2024694 | 1/1980 | United Kingdom . |

OTHER PUBLICATIONS

Lyman et al., Metals Handbook, vol. 1, 1961, American Society For Metals, 448–450.

*Primary Examiner*—Deborah L. Kyle
*Assistant Examiner*—Richard W. Wendtland
*Attorney, Agent, or Firm*—Walter Ottesen

[57] ABSTRACT

The invention is directed to a container for storing radioactive materials such as irradiated nuclear reactor fuel elements and the like. The vessel of the container is configured to have a plurality of wall layers. The inner wall layer of the vessel consists of a mechanically stable inexpensive metal material which is surrounded by a corrosion-protective wall layer made of high-alloy austenitic castable material with nodular graphite. The receiving opening of the vessel is closed by a sealing cover welded to the corrosion-protective layer. The container serves not only as a container for the final storage, it also can be utilized for a long-term storage at a surface location as well as for transport of the irradiated fuel elements. The amount of material needed for the corrosion-protective layer is held as low as possible. This is achieved by casting a wall layer of cast iron containing nodular graphite in surrounding relationship to the corrosion-resistant wall layer. The thickness of this outer wall layer is selected to afford the required shielding effect.

3 Claims, 2 Drawing Figures

CONTAINER FOR STORING RADIOACTIVE MATERIAL

FIELD OF THE INVENTION

The invention relates to a container for storing radioactive materials such as irradiated nuclear reactor fuel elements. The vessel of the container is configured to have a plurality of wall layers of which the inner wall layer is made of a mechanically stable and inexpensive material. Another wall layer is cast in surrounding relationship to the inner wall layer so as to be contiguous therewith and is a corrosion-protective layer made of high-alloy austenitic castable materials containing nodular graphite. The opening of the container is closed with a sealing cover welded to the corrosion-protective wall layer.

BACKGROUND OF THE INVENTION

The spent nuclear reactor fuel elements are loaded into a transport container for transporting the same to a storage area. These transport containers must be closed so as to be gas-tight and this is achieved with a cover sealing system. Also, the transport containers must provide adequate shielding against radioactivity. In addition, the transport containers must have an adequate mechanical strength which can also resist accident conditions. Further, the transport container has to be so configured that the heat of radioactive decay can be safely conducted to the outside.

The loaded transport containers are transferred to a temporary storage facility where they are kept until the irradiated nuclear reactor fuel elements are reprocessed or until they are put away for long-term storage or direct final storage. The transport containers must then be opened again. In the event that a direct final storage is decided upon, the spent nuclear reactor fuel elements must be packed in special final storage containers and, in these containers, the nuclear reactor fuel elements are transferred to geological formations for safe final storage.

The final storage containers just have certain final storage characteristics. Such containers must be mechanically stable, corrosion-resistant and tightly sealed. The vessel of the final storage container is therefore made of steel or cast iron in order to guarantee the mechanical stability of the container. It is preferable to use cast iron with nodular graphite (GGG-40) for the thick-walled container vessels because spheroidal cast iron exhibits high strength and toughness. The grade GGG-40 is listed in German Nodular cast iron specifications.

Since the corrosion resistance of steel or cast iron with nodular graphite is inadequate for the purpose of final storage, it has been suggested to apply a corrosion-resistant protective layer to the outside of the container vessel made of steel or cast iron. This corrosion-resistant protective layer can be made of ceramic, graphite or other material.

In the copending application entitled "A Container for the Interim and Long-term Storage of Radioactive Material" having Ser. No. 451,934 and filed on Dec. 21, 1982, it is disclosed that a container for the final storage of irradiated nuclear reactor fuel elements can be made so that it has a vessel having two metal wall layers wherein the inner wall layer is made of a mechanically stable, inexpensive material and the outer wall layer is made of a corrosion-resistant material. The inner layer is made of cast iron with nodular graphite or laminar graphite and the outer layer is made of a high-alloy austenitic castable material with nodular graphite. The outer layer is cast in surrounding relationship to the inner layer. The receiving opening of the container is closed by means of a sealing cover welded to the outer layer.

The fuel element container configured as described above can be also utilized for a longer term storage of the irradiated fuel at a surface location and for transporting the same if the thickness of the inexpensive inner layer is increased to correspond to the requirements for shielding. However, a consequence of this arrangement is that the costly corrosion protective wall layer, which must have a pre-determined thickness in order to be adequate for the final storage, is applied to an inner wall layer of a container vessel having a larger diameter. The size and therefore the amount of material required for the corrosion protective layer is increased.

SUMMARY OF THE INVENTION

It is an object of the invention to provide a container of the type described above that can be used not only for final storage, but also for longer term storage at a surface location and for the transport of the irradiated fuel elements while at the same time holding the quantity of material needed for the corrosion-resistant protective layer as low as possible.

The container of the invention for storing radioactive materials such as irradiated nuclear reactor fuel elements includes a vessel having an upper end portion defining the opening of the vessel through which the radioactive materials to be stored therein are passed. The vessel is a body having a multi-layered wall. The body has an inner wall layer made of a mechanically strong inexpensive metal material and at least one intermediate wall layer cast in surrounding relationship to the inner wall layer so as to be contiguous therewith. The intermediate wall layer is a corrosion-resistant layer made of high-alloy austenitic castable material containing nodular graphite. The vessel also has an outer wall layer cast in surrounding relationship to the corrosion-resistant wall layer. The outer wall layer is made of cast iron containing nodular graphite. A sealing cover is weldable to the corrosion-resistant layer for sealing the opening of the container.

It is possible to keep the corrosion-resistant wall layer of the container vessel at a smallest possible diameter because the thickness of the outer wall layer can be so selected that it provides the required shielding effect. The outer wall layer is cast in surrounding relationship to the corrosion-protective wall layer in a mold. The outer surface of the corrosion-protective wall layer melts so that a good bond between the outer wall layer and the corrosion-protective wall layer is obtained.

The good bond between the two wall layers is also promoted because the structural configuration of the outer wall layer is similar to the structural configuration of the corrosion-protective wall layer. The outer wall layer of spheroidal cast iron is very well suited for the use to which the invention is put because of the high-yield strength of this material and, because of this characteristic, the nodular cast iron can withstand the high shrinkage stress.

According to another feature to the invention, the inner wall layer can be made from a drawn steel tube. This affords the significant advantage that the inner wall layer can have a smaller thickness because of the higher mechanical strength of a drawn steel tube. This smaller thickness means that the inner wall layer has a smaller outer diameter. This has the advantageous consequence that the expensive protective wall layer too can have a smaller diameter and therefore have a smaller outer dimension.

The invention provides a fuel element container which receives the irradiated nuclear fuel elements delivered in the transport containers after a pre-determined time has elapsed during which radioactive decay has occurred. The fuel elements can be stored in this fuel element container at a temporary storage facility at a surface location until the final storage area is constructed or it is decided to subject the fuel elements to reprocessing.

In the event that it is decided to reprocess the irradiated nuclear fuel elements, the welded cover is milled open and the fuel elements are taken therefrom. If the fuel elements are to be placed in a geological formation for final storage, then the fuel element container is transferred into the final storage area without re-packing the fuel elements or an additional transport shielding arrangement. The fuel element container of the invention is tested pursuant to the conventional testing methods such as ultrasonic examination and x-ray examination during which each layer of casting is tested individually.

BRIEF DESCRIPTION OF THE DRAWING

The invention will now be described with reference to the drawing wherein.

DESCRIPTION OF THE PREFERRED EMBODIMENTS OF THE INVENTION

Figure 1:
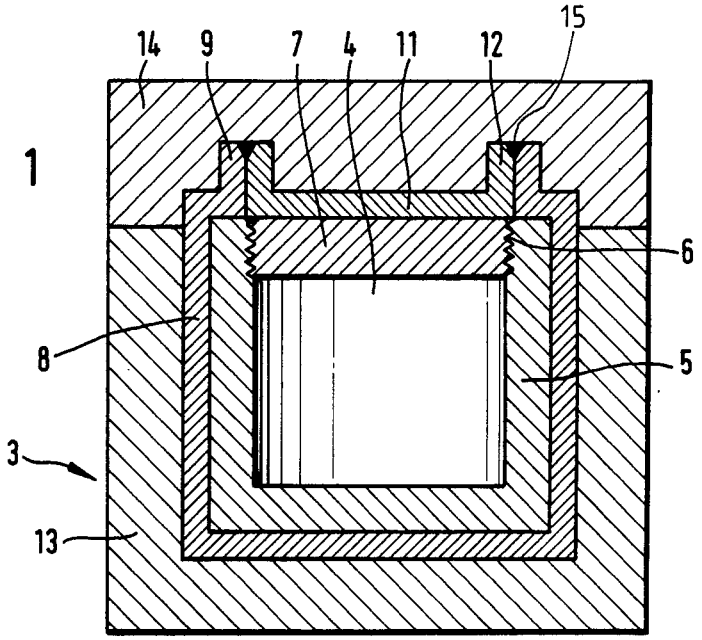
FIG. 1 is an elevation view, in section, of a fuel element container according to the invention.

The container according to FIG. 1 includes a thick walled vessel 3 which is made up of three wall layers. The vessel 3 holds fuel elements (not shown) and is of cylindrical configuration.

The vessel 3 is open at one of its ends. In this way, a receiving opening is formed for loading the container with fuel elements (not shown).

The inner layer 5 of the vessel 3 is made of spheroidal cast iron (GGG-40). At the open end of the vessel, the cup-shaped inner layer 5 is provided with an internal thread 6 which is threadably engaged by a pressure cover 7.

A corrosion-protective wall layer 8 made of a high-alloy austenitic spheroidal cast iron is cast about the inner wall layer 5. The castable material which constitutes the corrosion protection is an austenitic cast iron with a maximum of 3% carbon and 13 to 36% nickel as well as smaller alloy components of silicon, copper and chromium. A material of this kind is GGGNiCr 20.2 and is known commercially in Germany as "Ni-resist". At its open end, the enclosing corrosion-protective wall layer 8 includes a welding lip 9 which is concentric with respect to the receiving opening 4. A corrosion-protective cover 11 made of the same material as wall layer 8 is seated in the receiving opening 4. The cover 11 is trough-shaped and has a peripheral welding lip 12 which abuts against and is joined to the welding lip 9 of the wall layer 8 by a weld 15. The outer layer 13 of the vessel is made of cast iron containing nodular graphite (GGG-40).

A shielding cover 14 made of spherolitic cast iron is secured to the outer cast body 13 with threaded bolts.

During production of the container vessel, each cup-shaped cast wall layer is placed in the casting mold and serves as a casting form for the next outer layer. After the melt of the material making up the next layer is poured, the next layer forms a bond with the surface of the previously poured wall layer. The three wall layers of the container vessel 3 are thereby tightly joined to each other.

The corrosion-protective cover 11 is made of the same material as the corrosion-protective wall layer 8. A subsequent heat treatment of the container after the cover has been welded is therefore not necessary.

Figure 2:
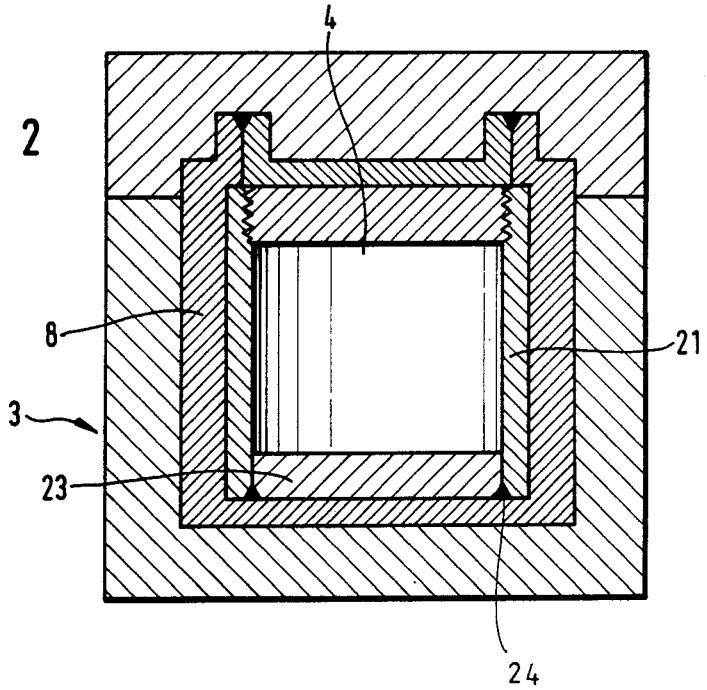
FIG. 2 is an alternate embodiment of the container of the invention having a three-layered wall wherein the inner wall layer is made from a drawn steel tube.

In the embodiment according to FIG. 2, the inner wall layer 21 is made of a drawn steel tube. A circular steel plate 23 is welded to inner wall layer 21 by weld 24 at the end thereof opposite the opening 4. Drawn steel tubes have a higher mechanical strength than do cast iron bodies corresponding thereto. Therefore, the inner wall layer 21 of the vessel 3 can be made thinner. This provides the advantage that the intermediate corrosion-protective wall layer 8 has a smaller diameter.

It is understood that the foregoing description is that of the preferred embodiments of the invention and that various changes and modifications may be made thereto without departing from the spirit and scope of the invention as defined in the appended claims.

What is claimed is:

1. A container for storing radioactive materials such as irradiated nuclear reactor fuel elements comprising:

a vessel having an upper end portion defining the opening of the vessel through which the radioactive materials to be stored therein are passed;

said vessel being a body having a multi-layered wall and including: an inner wall layer defining an enclosure for holding the radioactive materials, said inner wall layer being made of spheroidal cast iron; an intermediate wall layer cast in surrounding relationship to said inner wall layer so as to be contiguous therewith, said intermediate wall layer being a corrosion-resistant layer made of austenitic spheroidal cast iron for protecting said inner wall layer against corrosion; and, an outer wall layer cast in surrounding relationship to said corrosion-resistant intermediate layer, said outer wall layer also being made of spheroidal cast iron and having a thickness sufficient to provide shielding against radiation; and, sealing cover means for sealing said opening.

2. A container for storing radioactive materials comprising:

a vessel having an upper end portion defining the opening of the vessel through which the radioactive materials to be stored therein are passed;

said vessel being a cup-like multi-layered body including: an inner wall layer made of a section of drawn steel conduit capped with a steel plate at the lower end thereof; a corrosion-resistant intermediate wall layer made of austenitic spheroidal cast iron and disposed in surrounding relationship to said inner wall layer so as to be contiguous with the outer surface of the latter; and, an outer wall layer made of spheroidal cast iron and disposed in surrounding relationship to said intermediate wall layer so as to be contiguous to the outer surface of the latter, said outer wall layer having a thickness sufficient to provide shielding against radiation; and, sealing cover means for sealing said opening.

3. A container for storing radioactive materials such as irradiated nuclear reactor fuel elements comprising:

a vessel having an upper end portion defining the opening of the vessel through which the radioactive materials to be stored therein are passed;

said vessel being a cup-like multi-layered body including: an inner wall layer made of spheroidal cast iron; a corrosion-resistant intermediate wall layer made of austenitic spheroidal cast iron and disposed in surrounding relationship to said inner wall layer so as to be contiguous with the outer surface of the latter; and, an outer wall layer made of spheroidal cast iron and disposed in surrounding relationship to said intermediate wall layer so as to be contiguous to the outer surface of the latter, said outer wall layer having a thickness sufficient to provide shielding against radiation;

first cover means made of spheroidal cast iron and being engageable with said inner wall layer for closing off said opening;

second cover means made of austenitic spheroidal cast iron and weldable to said intermediate wall layer for tightly sealing said opening with respect to the ambient; and third cover means made of spheroidal cast iron secured to said outer wall layer for conjointly defining therewith a radioactive shield in surrounding relationship to said second cover means and said intermediate wall layer.

* * * * *

UNITED STATES PATENT AND TRADEMARK OFFICE

CERTIFICATE OF CORRECTION

PATENT NO. : 4,569,818

DATED : February 11, 1986

INVENTOR(S) : Franz-Wolfgang Popp and Kurt Feuring

It is certified that error appears in the above-identified patent and that said Letters Patent is hereby corrected as shown below:

On the cover page of the patent, under the heading "Inventors": delete "Kürt Füring" and substitute -- Kurt Feuring -- therefor.

In column 1, line 14: delete "materials" and substitute -- material -- therefor.

In column 1, line 42: delete "just" and substitute -- must -- therefor.

In column 1, line 51: delete "Nodular" and substitute -- nodular -- therefor.

Signed and Sealed this

First Day of July 1986

[SEAL]

Attest:

DONALD J. QUIGG

Attesting Officer

Commissioner of Patents and Trademarks